US006338406B1

(12) United States Patent
Zagar

(10) Patent No.: US 6,338,406 B1
(45) Date of Patent: Jan. 15, 2002

(54) BRUSH PROTECTION DEVICE

(76) Inventor: Robert R. Zagar, 8349 E. Louise Dr., Tucson, AZ (US) 85730

( * ) Notice: Subject to any disclaimer, the term of this patent is extended or adjusted under 35 U.S.C. 154(b) by 0 days.

(21) Appl. No.: 09/675,171

(22) Filed: Sep. 29, 2000

(51) Int. Cl.[7] ..... B65D 83/10

(52) U.S. Cl. ..... 206/362.2; 206/15.3; 206/493; 206/806; 220/4.22

(58) Field of Search ..... 206/361, 362.2, 206/363.3, 15.2, 15.3, 493, 372, 373, 806; 220/324, 326, 841, 843, 844, 848, 4.24, 4.23, 830, 4.22; 211/65, 66; 248/110, 113

(56) References Cited

U.S. PATENT DOCUMENTS

| | | | | | |
|---|---|---|---|---|---|
| 1,239,638 | A | | 9/1917 | Throckmorton | |
| 1,437,822 | A | | 12/1922 | Seymour | |
| 1,951,576 | A | | 3/1934 | Lehr | |
| 2,004,320 | A | | 6/1935 | Hanson | |
| 2,051,267 | A | | 8/1936 | Mezey | |
| 2,804,229 | A | * | 8/1957 | Bergh et al. | 220/830 |
| 3,136,409 | A | * | 6/1964 | Schumann | 206/361 |
| 3,800,998 | A | * | 4/1974 | Gask | 206/461 |
| 5,009,222 | A | * | 4/1991 | Her | 220/4.22 |
| 5,076,460 | A | * | 12/1991 | Hussell | 220/831 |
| 5,078,266 | A | * | 1/1992 | Rackley | 206/349 |
| 5,244,090 | A | * | 9/1993 | Keith | 206/361 |
| D350,234 | S | | 9/1994 | Losole | |
| 5,375,734 | A | * | 12/1994 | Tiramani | 220/523 |
| 5,540,363 | A | * | 7/1996 | Wilson | 224/148.7 |
| 5,645,167 | A | | 7/1997 | Conrad | |
| 5,966,902 | A | * | 10/1999 | Korycki | 53/397 |
| 6,036,050 | A | * | 3/2000 | Ruane | 220/831 |
| D436,450 | S | * | 1/2001 | Wilson | D4/199 |
| 6,199,694 | B1 | * | 3/2001 | Van Diest et al. | 206/361 |

* cited by examiner

*Primary Examiner*—Shian Luong

(57) ABSTRACT

A brush protection device for preventing the bristles from becoming stiff and hard after each use. The brush protection device includes a first cover member having a main wall, a front end, and a back end; and also includes a second cover member having a main wall, a front end, and a back end which is pivotally attached to the back end of the first cover member; and further includes a hinge assembly including first bracket members being securely attached at the back end of the first cover member and also including second bracket members being securely attached at the back end of the second cover member; and also includes a latching assembly for latching the first and second cover members together.

19 Claims, 2 Drawing Sheets

BRUSH PROTECTION DEVICE

BACKGROUND OF THE INVENTION

1. Field of the Invention

The present invention relates to a brush case and more particularly pertains to a new brush protection device for preventing the bristles from becoming stiff and hard after each use.

2. Description of the Prior Art

The use of a brush case is known in the prior art. More specifically, a brush case heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,437,822; U.S. Pat. No. 1,951,576; U.S. Pat. No. 5,645,167; U.S. Pat. No. 2,051,267; U.S. Pat. No. 1,239,638; U.S. Pat. No. 2,004,320; and U.S. Pat. No. Des. 350,234.

While these devices fulfill their respective, particular objectives and requirements, the aforementioned patents do not disclose a new brush protection device. The inventive device includes a first cover member having a main wall, a front end, and a back end; and also includes a second cover member having a main wall, a front end, and a back end which is pivotally attached to the back end of the first cover member; and further includes a hinge assembly including first bracket members being securely attached at the back end of the first cover member and also including second bracket members being securely attached at the back end of the second cover member; and also includes a latching assembly for latching the first and second cover members together.

In these respects, the brush protection device according to the present invention substantially departs from the conventional concepts and designs of the prior art, and in so doing provides an apparatus primarily developed for the purpose of preventing the bristles from becoming stiff and hard after each use.

SUMMARY OF THE INVENTION

In view of the foregoing disadvantages inherent in the known types of brush case now present in the prior art, the present invention provides a new brush protection device construction wherein the same can be utilized for preventing the bristles from becoming stiff and hard after each use.

The general purpose of the present invention, which will be described subsequently in greater detail, is to provide a new brush protection device which has many of the advantages of the brush case mentioned heretofore and many novel features that result in a new brush protection device which is not anticipated, rendered obvious, suggested, or even implied by any of the prior art brush case, either alone or in any combination thereof.

To attain this, the present invention generally comprises a first cover member having a main wall, a front end, and a back end; and also includes a second cover member having a main wall, a front end, and a back end which is pivotally attached to the back end of the first cover member; and further includes a hinge assembly including first bracket members being securely attached at the back end of the first cover member and also including second bracket members being securely attached at the back end of the second cover member; and also includes a latching assembly for latching the first and second cover members together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new brush protection device which has many of the advantages of the brush case mentioned heretofore and many novel features that result in a new brush protection device which is not anticipated, rendered obvious, suggested, or even implied by any of the prior art brush case, either alone or in any combination thereof.

It is another object of the present invention to provide a new brush protection device which may be easily and efficiently manufactured and marketed.

It is a further object of the present invention to provide a new brush protection device which is of a durable and reliable construction.

An even further object of the present invention is to provide a new brush protection device which is susceptible of a low cost of manufacture with regard to both materials and labor, and which accordingly is then susceptible of low prices of sale to the consuming public, thereby making such brush protection device economically available to the buying public.

Still yet another object of the present invention is to provide a new brush protection device which provides in the apparatuses and methods of the prior art some of the advantages thereof, while simultaneously overcoming some of the disadvantages normally associated therewith.

Still another object of the present invention is to provide a new brush protection device for preventing the bristles from becoming stiff and hard after each use.

Yet another object of the present invention is to provide a new brush protection device which includes a first cover member having a main wall, a front end, and a back end; and also includes a second cover member having a main wall, a front end, and a back end which is pivotally attached to the back end of the first cover member; and further includes a hinge assembly including first bracket members being securely attached at the back end of the first cover member and also including second bracket members being securely attached at the back end of the second cover member; and also includes a latching assembly for latching the first and second cover members together.

Still yet another object of the present invention is to provide a new brush protection device that keeps the bristles flexible and usable.

Even still another object of the present invention is to provide a new brush protection device that is easy and convenient to use and close about the bristles of the brush.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
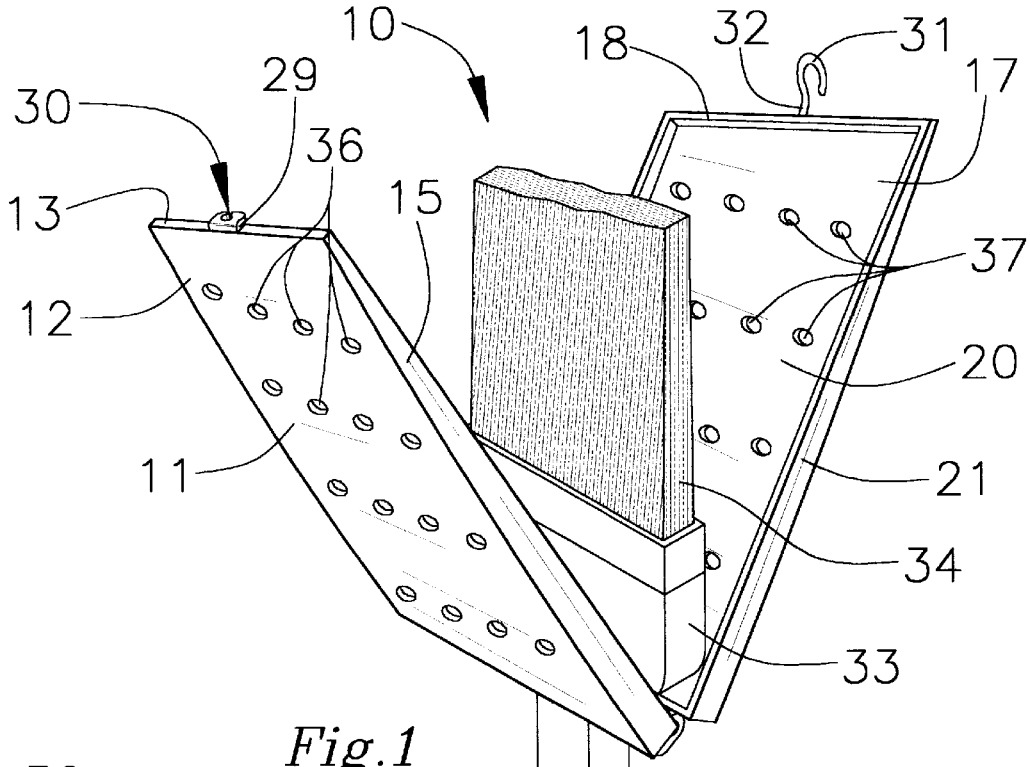
FIG. 1 is a perspective view of a new brush protection device according to the present invention and shown in use.
Figure 2:
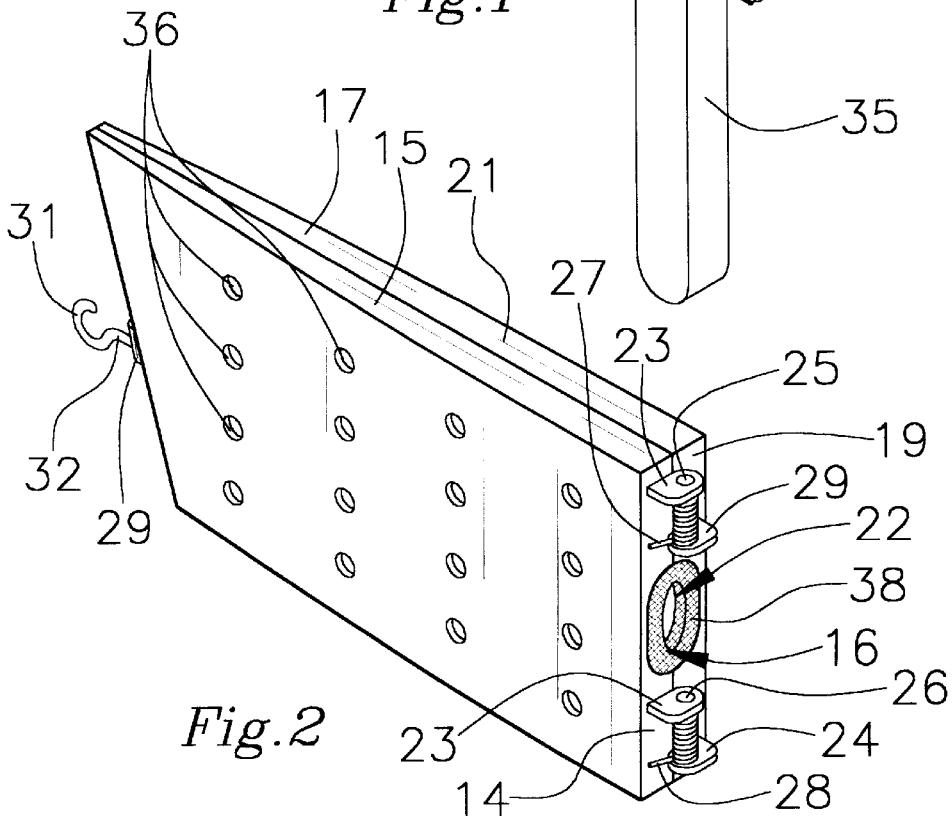
FIG. 2 is a bottom perspective view of the present invention.
Figure 3:
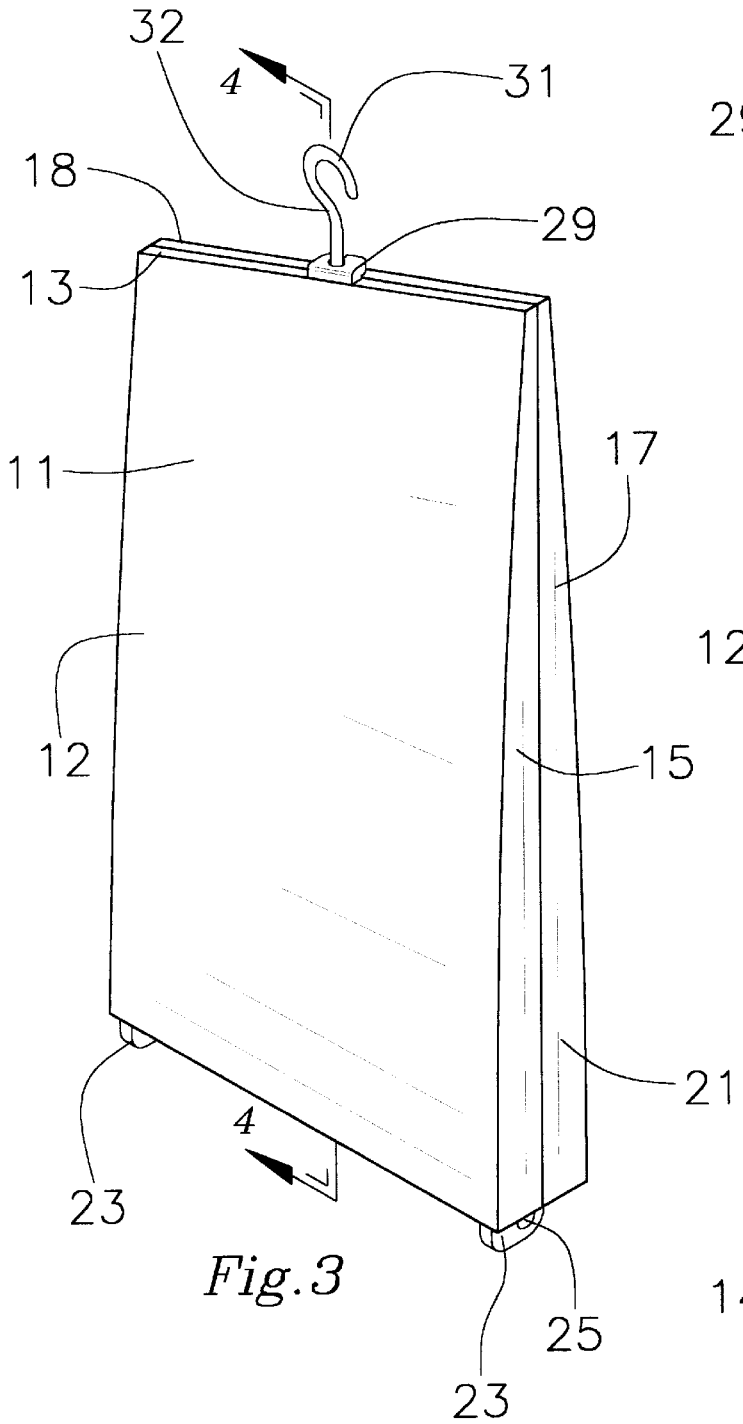
FIG. 3 is a top perspective view of the present invention.
Figure 4:
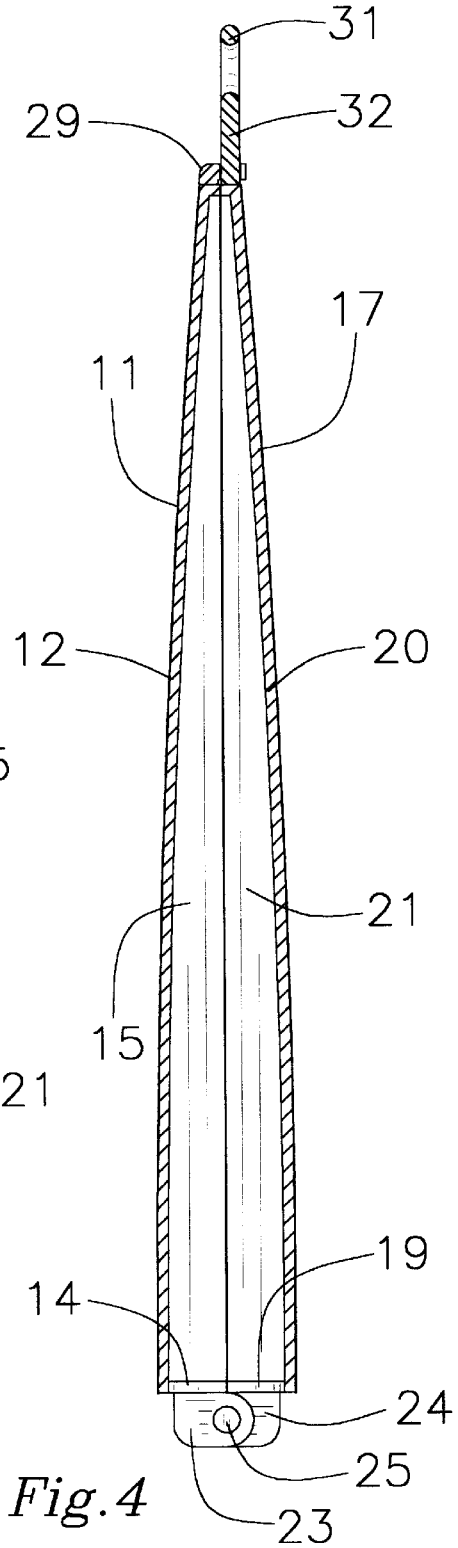
FIG. 4 is a cross-sectional view of the present invention.

With reference now to the drawings, and in particular to FIGS. 1 through 4 thereof, a new brush protection device embodying the principles and concepts of the present invention and generally designated by the reference numeral 10 will be described.

As best illustrated in FIGS. 1 through 4, the brush protection device 10 generally comprises a first cover member 11 having a main wall 12, a front end 13, and a back end 14; and also comprises a second cover member 17 having a main wall 20, a front end 18, and a back end 19 which is pivotally attached to the back end 14 of the first cover member 11. The first cover member 11 also includes side walls 15 being tapered from the back end 14 to the front end 13 thereof, and the second cover member 17 also includes side walls 21 being tapered from the back end 19 to the front end 18 thereof with the side walls 15,21 of the first and second cover members 11,17 being in contactable relationship with one another. Each of the first and second cover members 11,17 has an arcuate slot 16,22 disposed through the back end 14,19 thereof with the arcuate slots 16,22 being aligned with one another to essentially form a hole through the back ends 14,19 of the first and second cover members 11,17. The hole is adapted to receive a handle 35 of a brush 33 therethrough. The first and second cover members 11,17 are closable upon one another to essentially form a storage compartment therebetween with the storage compartment being adapted to receive and store a head portion 34 of the brush 33 including bristles of the brush 33.

A hinge assembly includes first bracket members 23 being securely and conventionally attached at the back end 14 of the first cover member 11 and also includes second bracket members 24 being securely and conventionally attached at the back end 19 of the second cover member 17. The hinge assembly further includes elongate fastening members 25,26 each of which is conventionally connected to a respective first and second bracket member 23,24, and also includes springs 27,28 each of which is mounted about a respective elongate fastening member 25,26 for biasing the first and second cover members 11,17 together.

A latching assembly for latching the first and second cover members 11,17 together includes a catch member 29 being securely and conventionally attached at the front end 13 of the first cover member 11, and also includes a hook member 31 being securely and conventionally attached at the front end 18 of the second cover member 17 and extending outwardly therefrom. The catch member 29 has a slot 30 disposed in an edge thereof, and the hook member 31 includes a stem 32 which is removably received in the slot 30 of the catch member 29 to essentially close and secure the first and second cover members 11,17 about the head portion 34 of the brush 33.

In use, the user opens the first and second cover members 11,17 and extends the handle 35 of the brush 33 through the hole and closes and secures the first and second cover members 11,17 about the head portion 34 of the brush 33 to essentially prevent the bristles of the brush 33 from drying out after each use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A brush protection device comprising:

a first cover member having a main wall, a front end, and a back end;

a second cover member having a main wall, a front end, and a back end which is pivotally attached to said back end of said first cover member;

a hinge assembly including first bracket members being securely attached at said back end of said first cover member and also including second bracket members being securely attached at said back end of said second cover member; and a latching assembly for latching said first and second cover members together;

wherein each of said first and second cover members has an arcuate slot disposed through said back end thereof, said arcuate slots being aligned with one another to essentially form a hole through said back ends of said first and second cover members, said hole being adapted to receive a handle of a brush therethrough.

2. A brush protection device as described in claim 1, wherein said first cover member also includes side walls being tapered from said back end to said front end thereof, and said second cover member also includes side walls being tapered from said back end to said front end thereof, said side walls of said first and second cover members being in contactable relationship with one another.

3. A brush protection device as described in claim 1, wherein said first and second cover members are closable upon one another to essentially form a storage compartment therebetween, said storage compartment being adapted to receive and store a head portion of the brush including bristles of the brush.

4. A brush protection device as described in claim 1, wherein said hinge assembly further includes elongate fastening members each of which is connected to a respective said first and second bracket member, and also includes springs each of which is mounted about a respective said elongate fastening member for biasing said first and second cover members together.

5. A brush protection device as described in claim 1, wherein said latching assembly includes a catch member being securely attached at said front end of said first cover member, and also includes a hook member being securely attached at said front end of said second cover member and extending outwardly therefrom.

6. A brush protection device as described in claim 5, wherein said catch member has a slot disposed in an edge thereof, and said hook member includes a stem which is removably received in said slot of said catch member to essentially close and secure said first and second cover members about the head portion of the brush.

7. A brush protection device comprising:

a first cover member having a main wall, a front end, and a back end;

a second cover member having a main wall, a front end, and a back end which is pivotally attached to said back end of said first cover member;

a hinge assembly pivotally connecting the back ends of said first and second cover members such that said first and second cover members are pivotable between a closed and an open position, said first and second cover members in said closed position defining a storage compartment for receiving a head portion of a brush including bristles of the brush; and a latching assembly for releasably latching said first and second cover members together in said closed position;

wherein an aperture for receiving a handle portion of the brush is located adjacent to said hinge assembly such that the handle portion of the brush is extendable through said aperture when the head portion of the brush is positioned in said storage compartment; and wherein each of said first and second cover members has an arcuate slot disposed through said back end thereof to form said aperture, said arcuate slots being aligned with one another to essentially form a hole through said back ends of said first and second cover members, said hole being adapted to receive a handle of a brush therethrough.

8. A brush protection device as described in claim 7, wherein said first cover member also includes side walls being tapered from said backend to said front end thereof, and said second cover member also includes side walls being tapered from said back end to said front end thereof, said side walls of said first and second cover members being in contactable relationship with one another.

9. A brush protection device as described in claim 7, wherein said hinge assembly includes a spring for biasing said first and second cover members into said closed position.

10. A brush protection device as described in claim 7, wherein said latching assembly includes a catch member being securely attached at said front end of said first cover member, and also includes a hook member being securely attached at said front end of said second cover member and extending outwardly therefrom.

11. A brush protection device as described in claim 7, wherein said catch member has a slot disposed in an edge thereof, and said hook member includes a stem which is removably received in said slot of said catch member to essentially close and secure said first and second cover members about the head portion of the brush.

12. A brush protection device as described in claim 7, wherein said hinge assembly includes a pair of hinges, and said aperture is positioned between said hinges.

13. A brush protection device as described in claim 7, wherein a hook is mounted on one of said cover members at the front end thereof.

14. A brush protection device comprising:

a first cover member having a main wall, a front end, and a back end;

a second cover member having a main wall, a front end and a back end which is pivotally attached to said back end of said first cover member;

a hinge assembly pivotally connecting the back ends of said first and second cover members such that said first and second cover members are pivotable between a closed and an open position, said first and second cover members in said closed position defining a storage compartment for receiving a head portion of a brush including bristles of the brush; and a latching assembly for releasably latching said first and second cover members together in said closed position;

wherein an aperture for receiving a handle portion of the brash is located adjacent to said hinge assembly such that the handle portion of the brush is extendable through said aperture when the head portion of the brush is positioned in said storage compartment; and wherein said hinge assembly includes a pair of hinges and said aperture is positioned between said hinges.

15. A brush protection device as described in claim 14, wherein said first cover member also includes side walls being tapered from said back end to said front end thereof, and said second cover member also includes side walls being tapered from said back end to said front end thereof, said side walls of said first and second cover members being in contactable relationship with one another.

16. A brush protection device as described in claim 14, wherein said hinge assembly includes a spring for biasing said first and second cover members into said closed position.

17. A brush protection device as described in claim 14, wherein said latching assembly includes a catch member being securely attached at said front end of said first cover member, and also includes a hook member being securely attached at said front end of said second cover member and extending outwardly therefrom.

18. A brush protection device as described in claim 14, wherein said catch member has a slot disposed in an edge thereof, by and said hook member includes a stem which is removably received in said slot of said catch member to essentially close and secure said first and Second cover members about the head portion of the brush.

19. A brush protection device as described in claim 14, wherein a hook is mounted on one of said cover members at the front end thereof.

* * * * *